United States Patent [19]

Mitchell

[11] Patent Number: 5,003,712

[45] Date of Patent: Apr. 2, 1991

[54] APPARATUS FOR CLEANING IRRIGATION DITCH

[76] Inventor: Rex P. Mitchell, 1263 E. Avila, Casa Grande, Ariz. 85222

[21] Appl. No.: 400,400

[22] Filed: Aug. 28, 1989

[51] Int. Cl.[5] ..... E02F 5/02; E02F 3/02

[52] U.S. Cl. ..... 37/80 R; 37/118 A; 37/130; 37/137; 37/191 A; 15/93.3

[58] Field of Search ..... 37/80 R, 80 A, 82, 85, 37/90, 118 A, 130, 137-139; 15/3, 93 B

[56] References Cited

U.S. PATENT DOCUMENTS

| | | | |
|---|---|---|---|
| 1,450,815 | 4/1923 | Neunaber et al. | 37/138 |
| 2,867,046 | 1/1959 | Baer | 37/85 |
| 4,109,336 | 8/1978 | Ford | 37/82 X |
| 4,819,348 | 4/1989 | DeBolt | 37/81 |
| 4,872,275 | 10/1989 | Beckett et al. | 37/91 |

FOREIGN PATENT DOCUMENTS

| | | | |
|---|---|---|---|
| 760254 | 10/1956 | United Kingdom | 37/80 R |

*Primary Examiner*—Randolph A. Reese
*Assistant Examiner*—Arlen L. Olsen
*Attorney, Agent, or Firm*—Joseph H. Roediger

[57] ABSTRACT

A self-propelled irrigation ditch cleaner for use by a single operator which includes a side-oriented conveyor to transport debris up and out of the ditch for the later collection.

15 Claims, 2 Drawing Sheets

FIG. 1
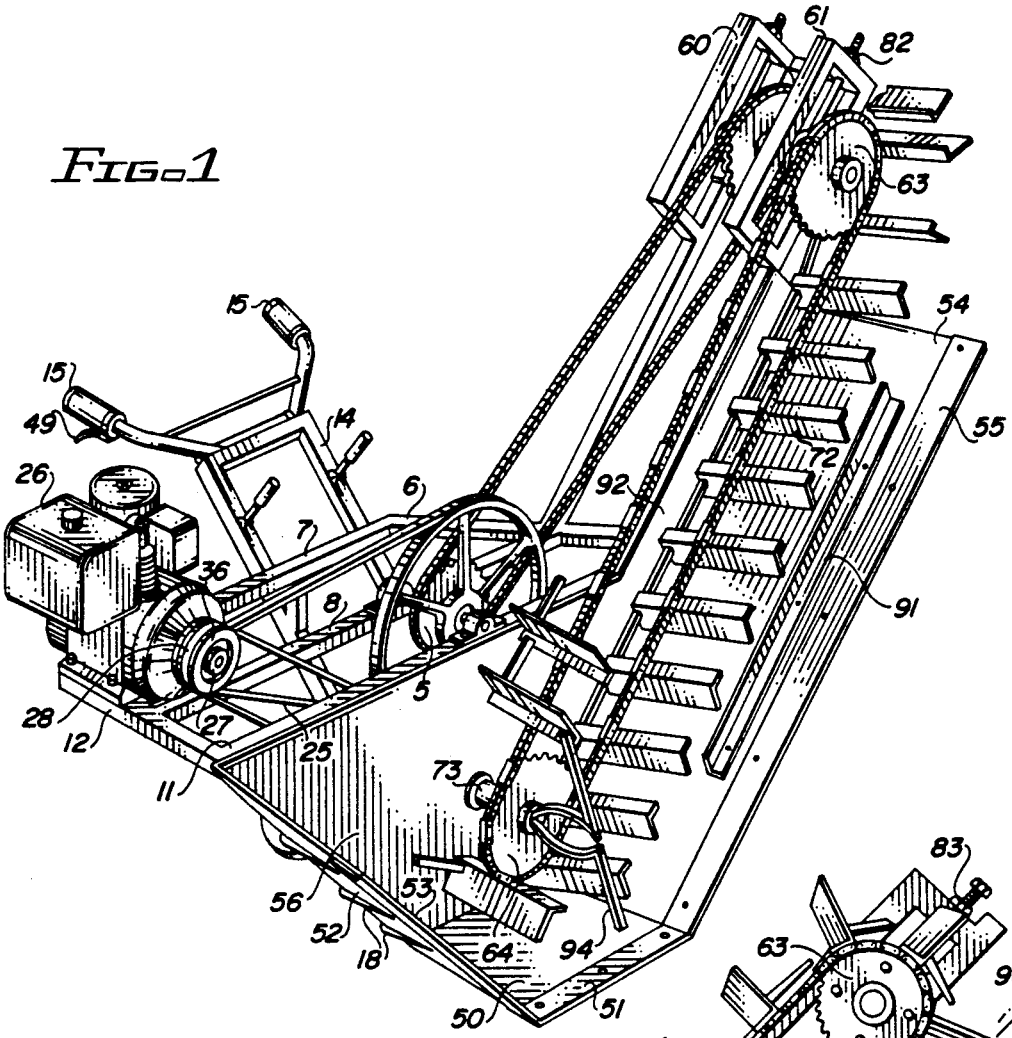
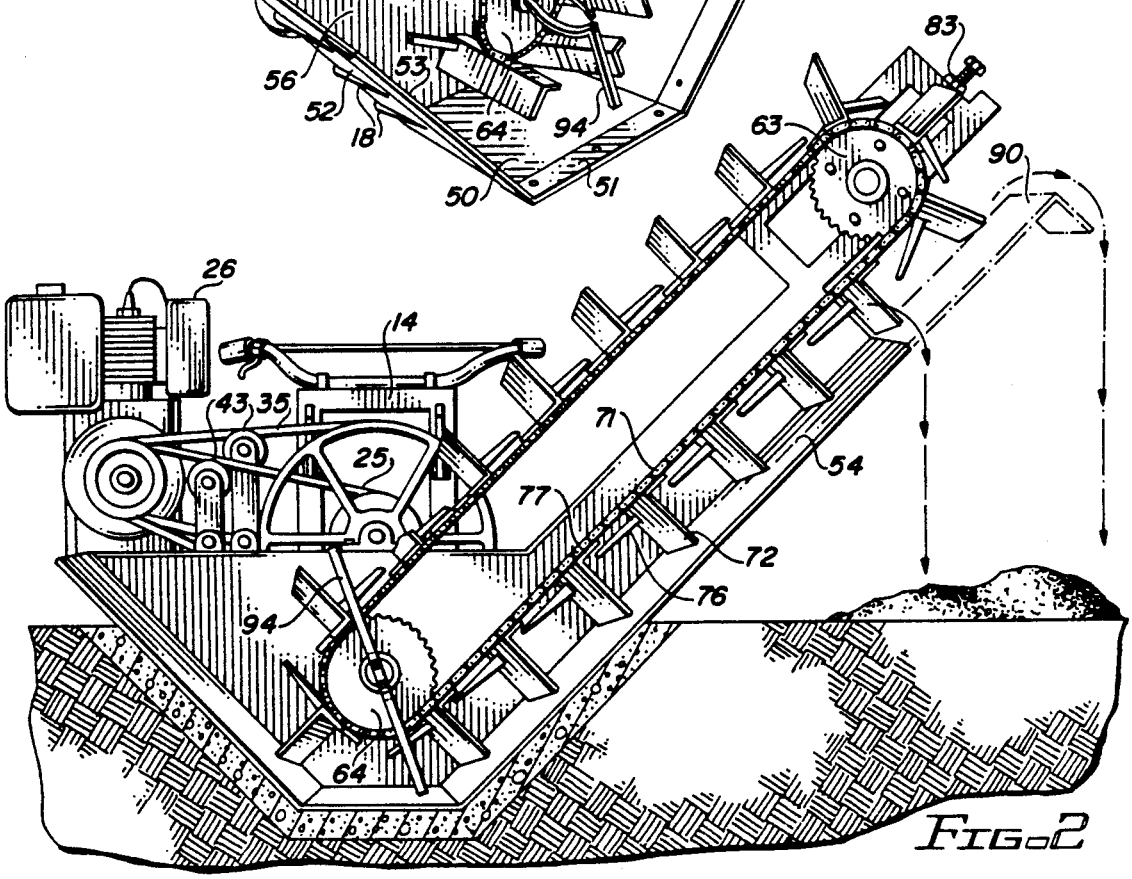
FIG. 2

APPARATUS FOR CLEANING IRRIGATION DITCH

BACKGROUND OF THE INVENTION

This invention relates to apparatus for removing debris from an irrigation ditch.

Agricultural activities in much of the United States takes place in an arid climate wherein the amount of rainfall is insufficient to provide sufficient moisture for commercial operations and their required high crop yields. Consequently, major sections of the southwestern portion of the United States rely on irrigation to deliver the moisture to the soil. In general, irrigation water flows from two types of sources with the first utilizing a canal network from a reservoir to a distribution point near the acreage or, alternatively, the water is derived from wells located adjacent the fields. In both cases, a distribution network of concrete lined ditches is used to distribute the water along the perimeter of the fields. Siphons are normally used to remove the water from the ditches and place it at the heads of the row crops planted in the fields. These irrigation practices are widely practiced and responsible to a major degree in the ability of our country's agricultural community to provide food and fiber at extremely low prices.

In the pumping of water for irrigation of fields, a significant amount of sedimentary matter accompanies the water and accumulates in the bottom of the ditches.

Also, the irrigation ditches border the fields and are open to permit placement of the siphons. However, they are located in arid regions of the country and consequently serve as catchments for particulate matter that is transported by the wind as well as receiving agricultural and other debris therein. Thus, to maintain their water carrying capability, the farmer must have his ditches periodically cleaned so that they can carry water to their effective or rated capacity. Ditches, unlike the major canals bringing water to the distribution points, are relatively small, often with a one foot wide base and three foot walls inclined at 45 degrees therefrom. Typically the depth of the ditches varies from 24 inches to 36 inches. Consequently, it is neither practical nor cost-effective to use road-worthy machinery to clean the ditches of the accumulated debris. Frequently, man power employing hand equipment removes the debris and places it on the surface of the field adjacent the ditch. The collection of the removed debris can be automated using front-end loaders, trucks or other road-based equipment.

Since economics plays a major part in the production of food and fiber in this country, and the cost of manual labor is ever increasing, it is advantageous to provide an automated means be which the ditches can be cleaned. It is also important to provide automated means for removing debris which can be operated by a single operator.

Accordingly, a primary object of the resent invention is the provision of automated irrigation ditch cleaning apparatus. Also, an objective is the provision of automated equipment that can be both laced within the ditch in position to remove accumulated debris, operated by a single individual and readily removed from the ditch at the completion of the operation. In addition, the resent invention is directed to apparatus for cleaning ditches wherein the accumulated debris is placed in position so as to be readily gathered by road-worthy equipment.

SUMMARY OF THE INVENTION

The present invention is concerned with the provision of apparatus which removes debris from the conventional concrete irrigation ditch wherein a bottom surface is bounded by side members that extend upwardly and outwardly therefrom. The apparatus includes a frame having a drivewheel that movably contacts the bottom surface of the irrigation ditch. A drive means is mounted on the frame and coupled to the drivewheel for propelling the frame along the ditch. The operator, standing in position behind the frame, has ready access to control means affixed thereto so as to permit the operator to control the drive means during operation.

A forwardly-extending base member is affixed to the frame with first and second upwardly-extending side members attached thereto so as to approximate the cross sectional profile of the ditch. Transport means for moving debris located at the bottom of the ditch is mounted on the frame proximate to the second side member. The transport means includes a plurality of moving flights thereon so as to take the debris along the second side member and remove it from the ditch. Coupling means are connected between the drive means and the transport means so that the single operator can control operation of the transport means as the apparatus is being moved along the bottom of the ditch. In a preferred embodiment, the second side member extends upwardly out of the ditch and outwardly beyond its edge so that debris is deposited on the surface region adjacent the ditch. Also, spaced channel guides are located on the second side member so that the flight urges the debris upwardly and out of the ditch in a path bounded by the channel guide.

The present invention utilizes a base member with upwardly-extending side members that are dimensioned to fit within the ditch so that only a single drive wheel is necessary in the preferred embodiment with stability being provided by the adjacent sidewalls of the irrigation ditch. As the drive means is actuated to move the apparatus along the ditch on the drive wheel, debris enters the apparatus upon the forwardly-extending base member and is engaged by the flights of the transport means to move it along the second side member. Since material is moving along the second side, the drive means in the preferred embodiment is mounted on the frame proximate to the first side member to improve the stability of the device and ease of operator handling.

To initiate operation of the invention, the operator enters the ditch by rolling the device on its drivewheel across the side wall of the ditch to the bottom. Exiting is accomplished in the same manner after completing a pass along the ditch. As a result of the present invention, a single operator can effectively clean a ditch in a reasonable period of time with the debris distributed along a single edge of the ditch for removal by other equipment available to the farmer.

Further features and advantages of the invention will become more readily apparent from the detailed description of the invention when taken in conjunction with the accompanying drawings.

BRIEF DESCRIPTION OF THE DRAWINGS

FIG. 1 is a view in perspective of one embodiment of the invention.

FIG. 2 is a front view of the embodiment of FIG. 1 in position in an irrigation ditch.

DESCRIPTION OF THE PREFERRED EMBODIMENT

Figure 4:
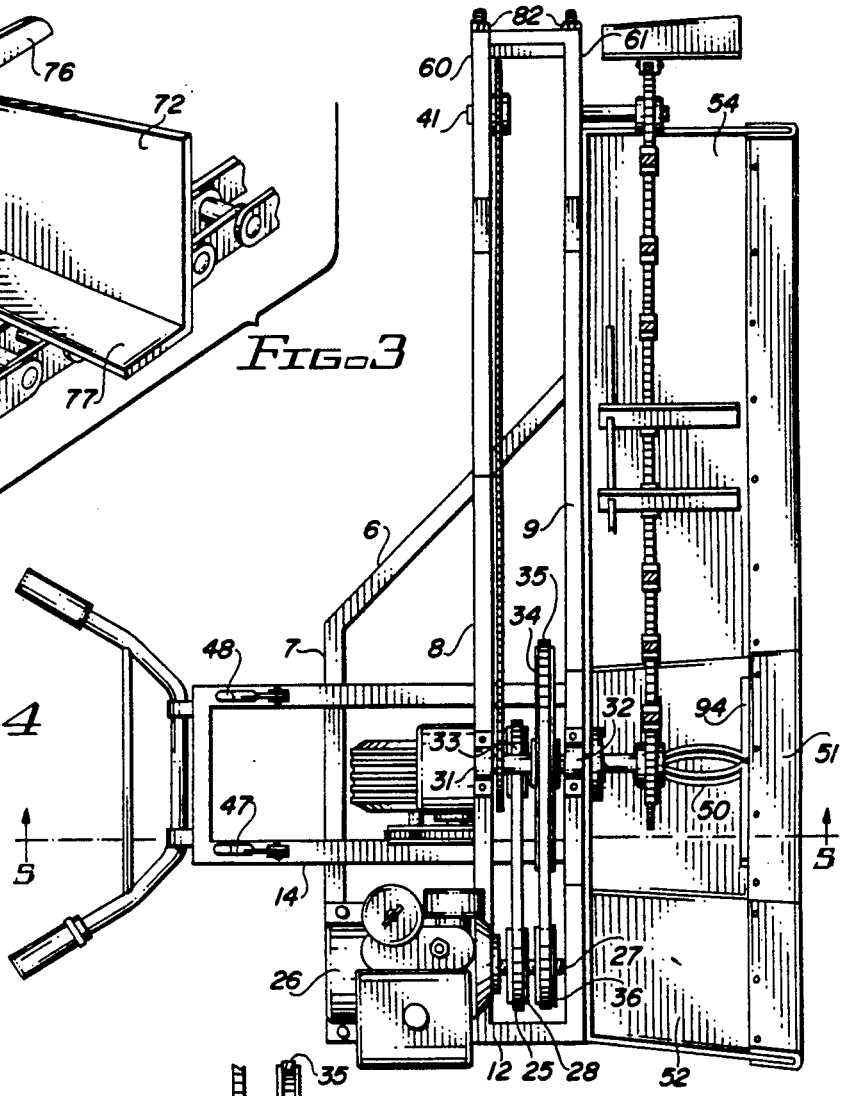
FIG. 4 is a top view of the embodiment of FIG. 1.

Referring now to FIGS. 1 and 4, the resent invention is shown including a frame 10 formed of transverse members 7, 8 and 9 affixed to side supports 6 and 12 in a plainar configuration. A generally rectangular rearwardly extending support 14 is shown receiving the end transverse member 7 thereon. Handgrippable segments 15 protrude rearwardly from the support 14 for operator control.

Figure 5:
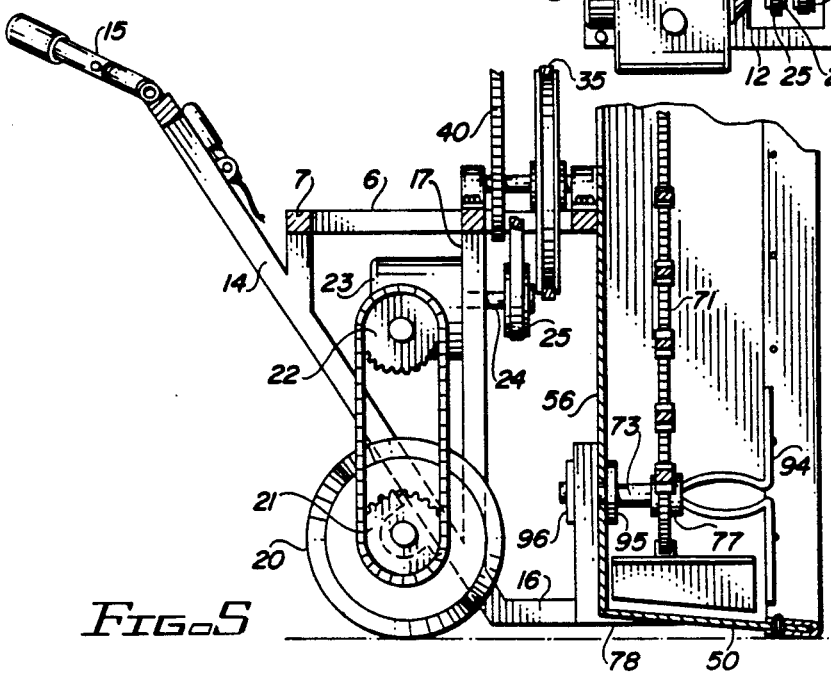
FIG. 5 is a side view of the embodiment shown in FIG. 4 taken along lines 5—5.

As shown more clearly in FIG. 5, the inclined support 14 extends downwardly to a generally horizontal support 16. A vertical support 17 is provided between the central transverse member 8 and the bottom section of support 14. These members are fixedly attached by welding to provide a rigid frame. At the bottom of the frame, drivewheel 20 is journaled for rotation in bearing block 21 affixed to the underside of support 14. Drivegear 22 is rotationally coupled through gearbox 23 to shaft 24. The gearbox is affixed to vertical member 17. A first drivebelt 25 extends upwardly to the drive means 26 for the apparatus which is mounted on the rearward section of the horizontal frame formed by the transverse elements and side supports. Drivemeans 26 is a gasoline powered engine which produces rotation of pulley 28 affixed to its driveshaft 27. The first drivebelt 25 extends downwardly in FIG. 1 to the driven pulley located on shaft 24 in FIG. 5. Thus, the engine of drive means 26 causes the drivewheel to move the frame and structural elements mounted thereon along the ground or irrigation ditch.

The generally horizontal frame shown comprising transverse elements 7, 8, and 9 and side supports 6 and 12 are not rectangular in shape as noted in FIG. 4 wherein the side support 6 prime located on the side away from the drive means 26 extends outwardly toward the front of the apparatus. The central transverse member 8 is considerably longer than the spaced adjacent transverse support 7 to accommodate the angle of the side support 6. The lack of symmetry in the frame provides the support for other elements of the apparatus.

The drive means 26 is provided with a second or outer pulley 36 on shaft 27 which is coupled by belt 35 to large diameter pulley 34 mounted on central shaft 33. The shaft 33 is journaled for rotation in bearing blocks 31 and 32 mounted on transverse supports 8 and 9. Thus, the drive means imparts motion to the drivewheel 20 through inner pulley 28 and belt 25 and to central shaft 33 as well. Shaft 33 contains a sprocket 5 with chain 40 thereon. The chain extends outwardly and upwardly to the transport means driveshaft 41.

Figure 6:
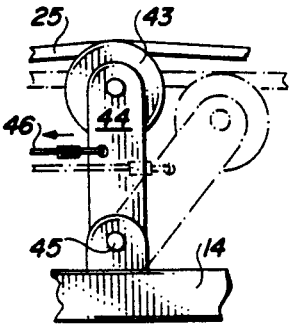
FIG. 6 is a view of a typical idler clutch employed in this embodiment of the invention.

Belt 25 and belt 35 are each provided with a belt clutch assembly as shown in FIG. 6 wherein an idler wheel 43 is rotationally mounted on movable arm 44. The arm 44 is urged against the adjacent belt by the application of tension to cable 46. When the idler wheel is firmly positioned against belt 25, the belt tension is increased so that it frictionally engages the pulley 28 and motion is imparted to the drivewheel. Cable 46 is preferably routed through the hollow rectangular barstock of the frame to clutch lever 47 located on the frame proximate to the hand grippable portion used by the operator to control the apparatus. A like clutch assembly is provided for the outer belt 35 and is routed to clutch lever 48. Consequently, the operator can control the drivewheel independently of the debris transport means of the apparatus. In the referred embodiment, a throttle lever 49 is shown attached to the hand grippable portion so that the engine speed of drive means 26 can be also controlled.

In the embodiment of FIGS. 1 and 4, the transverse members 8 and 9 extend upwardly from the side support 6 and terminate in protective enclosures 60 and 61 respectively. In the enclosures is shaft 41 journaled for rotation in bearing blocks mounted on the transverse supports 8 and 9. Sprockets 62 and 63 are affixed to shaft 41. As shown, drivechain 40 is returned to the sprocket on shaft 33 which is then coupled through belt 35 to the drive means 26. Rotation of sprocket 62 results in corresponding rotation of sprocket 63 and the movement of transport chain 71 having a plurality of conveyor flights 72 affixed thereto. The drivechain 71 extends around sprocket 64 which is affixed to shaft 73. This shaft is mounted for rotation on rearwall 56 of the apparatus.

As shown in FIGS. 4 and 5, the shaft 73 is rotationally secured to the rearwall 56 by bushings 95 and 96. Thus, sprocket 64 is a driven sprocket. In the present embodiment, a bladed member 94 is affixed to the central section of sprocket 64 and extends forwardly thereof. A reinforcing collar 77 provides structural support for the base of bladed member 94 which is positioned to contact the debris in advance of being transported out of the irrigation ditch by the conveyor flights. In operation, the bladed member rotates with the sprocket 64 and reduces the likelihood of the apparatus clogging when encountering large masses of debris.

The planar base member 50 with a removable forward edge 51 is attached to bottom frame element 16 by a plurality of laterally spaced wedge-shaped support members 78 seen in FIG. 5. While the base member is shown integral with the rear support plate 56, it is to be noted that the entire base member can be made as a separate replaceable cable part for the apparatus, if desired. The wedge-shaped support members 78 orient the base member so that its forward edge 51 is downwardly inclined toward the bottom of the ditch. First and second side members 52 and 54 respectively are affixed to the base member and rear support member. The side members are each provided with replaceable forward edges 53 and 55. Also, the side members are affixed to the frame by wedge-shaped support members 81 shown in part in FIG. 1 extending beneath the first side member 52 in supporting relationship thereto. Since the support members are inclined, the side members are supported in an open position which in combination with the downwardly inclined base member tends to urge debris encountered as the apparatus moves along the ditch into the region bounded by the base member and side walls.

Figure 3:
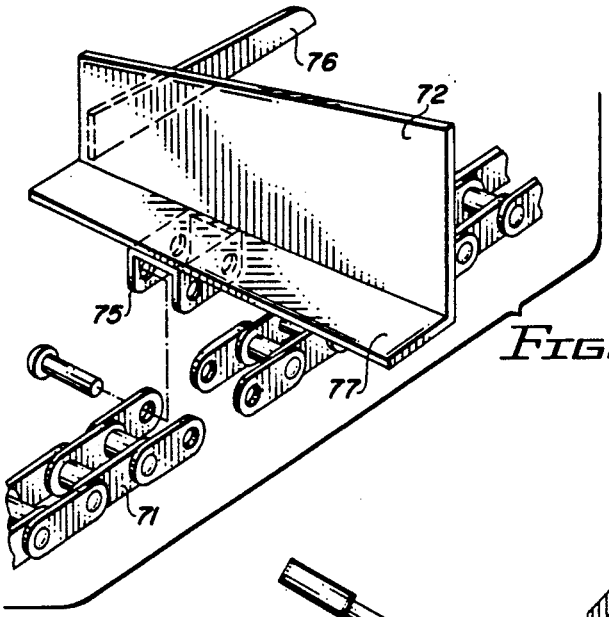
FIG. 3 is an exploded view in perspective of a flight used in the embodiment of the invention.

In operation, the sprocket 63 is driven by rotation of shaft 41 via chain 40 and drivebelt 25 by the gasoline engine 26. This causes the transport chain 71 with the series of conveyor flights 72 fastened thereto to move in proximity to the surface of the extended second side member 54. The transport chain 71 is shown in further detail in FIG. 3 wherein the forward lip 77 of each conveyor flight 72 is provided with a U-shaped member 75 affixed thereto. Alternatively, a pair of spaced bent lugs may be welded to the flight. As shown, the U-shaped member is provided with two aligned pairs of holes which enable the member to serve as a link in the transport chain. As the chain 71 moves about the sprockets 63 and 64, the flights located on the outside of the chain travel around the sprockets.

Each flight is provided with a rearward extension 76 and a forward lip 77. The rotation about sprocket 64 finds the extension 76 clearing the first side member 52 and the base member 50 as the chain continues to travel. When a particular flight completes its movement about sprocket 64 and begins movement along its upward 1 path adjacent the surface of the second side member 54, it is prevented from being deflected from its attitude normal to the chain by the extension 76 contacting the lip of 77 of the next succeeding flight. In operation, pressure applied to a conveyor flight tends to drive it in a rearward direction which is then resisted by the action of its extension 76 in contacting the lip 77 of the succeeding flight. This interaction between adjacently spaced flights on transport chain 71 is shown in FIG. 2 wherein the extension 76 overlies a portion of the forwardly extending lip 77 of the following flight 72. Thus, pressure brought to bear on a particular flight will be resisted by next flight on the chain. In addition, the extension 76 provides a scraping function to dislodge material having a tendency to adhere to the face of a flight as the preceding flight begins its movement about drive sprocket 63. The extension moves downwardly to engage any such adhering mass. Also shown in FIGS. 2 and 4 is a tension regulating mechanism designated generally by bolts 82 located between the protective enclosures 60 and 61. The rotation of the bolts shown adjusts the location of the shaft 40 to compensate for any sagging of the chain during use. In other embodiments, an idler sprocket can be adjustably mounted on the frame to permit independent adjustment of drive-chain 40.

The cross section of a typical concrete-lined irrigation ditch is shown in FIG. 2 with the machine in place for the removal of accumulated debris. The base member 50 and the first and second side members 52 and 54 are in substantial conformance with the dimensions of the ditch. When the operator starts engine 26 and engages the clutch levers located on the support frame 14, the drive force from the engine is transmitted through belts 25 and 35 to cause the machine to be propelled along the ditch while the drive sprocket 63 imparts motion to the transport chain 71. The flights 72 move upwardly along the path defined by the second edge member to urge debris outwardly onto the surface area adjacent the ditch. As shown in FIG. 2, an optional extension 90 to the second side member 54 can be utilized to control the horizontal distance from the ditch for the depositing of removed debris. Since the base member is inclined downwardly in the forward direction and the side members are opened or angled outwardly, substantially all the debris with the exception of minor amounts of silt enter the apparatus. The debris then encounters the rotating bladed member 76 and the succession of flights 72 as they travel across the base member. The debris is moved upwardly and outwardly along the second side member 54 to outside the ditch.

The side member 54 is provided with a front guide 91 in the preferred embodiment shown in FIG. 1. The guide is removably attached to the exposed surface of member 54 and is spaced from the bottom portion thereof so as not to interfere with the entry of debris into the apparatus. However, the guide serves to confine the debris to the upward and outward path for removal and reduces the opportunity for the debris to slough off the forward edge 55 of side member 54. For purposes of description, the front guide 91 is not shown in FIGS. 2 and 4. Also, the embodiment of FIG. 1 utilizes the rear support plate 56, shown extending upwardly the entire length of side member 54, as a back guide. This extension is shown in FIG. 1 as back guide 92. In other embodiments wherein the overall weight of the apparatus is to be reduced the back guide 92 is made identical with the front guide 91 and the rear support plate is substantially reduced in vertical height. Since the engine 26 provides a counter balancing weight for the elements located at the end of the extended second side member 54, the size and type of engine mounted thereon will determine in part the ease with which the apparatus can be transported across open ground by a single operator. In the case of a significant weight imbalance, the use of a counterweight placed beneath the engine 26 has been found to alleviate the problem.

While the forgoing description has referred to a specific embodiment of the invention, it is to be noted that many modifications and variations may be made therein without departing from the scope of the invention as claimed.

I claim:

1. Apparatus for removing debris from an irrigation ditch bounded by a bottom surface with side members extending upwardly therefrom said apparatus comprising:

(a) a frame including a drive wheel for movably contacting the bottom surface of an irrigation ditch;

(b) drive means mounted on said frame and coupled to said drive wheel for propelling said frame along the ditch;

(c) control means affixed to said frame for permitting operator control of said drive means;

(d) a forwardly-extending base member affixed to said frame, said base member having first and second opposing side edges and forward and rear edges;

(e) first and second upwardly-extending side members affixed to said first and second side edges respectively, said base and side members being dimensioned to fit within said ditch;

(f) a frame extension extending laterally from said frame in the direction of said second side member;

(g) transport means for moving the debris, said transport means being mounted on said frame and frame extension spaced adjacent to said second side member and including:

i. first and second sprockets affixed to said frame and said frame extension respectively, said first sprocket being located on said frame proximate to the base member, and ii. a chain containing spaced flights and encircling said first and second sprockets; and (h) coupling means connected to said drive means and including clutch means for controlling movement of said chain for imparting movement to the transport means whereby debris located on said base member is urged by the flights of said transport means upwardly along said second side member for removal from the ditch.

2. Apparatus in accordance with claim 1 wherein said second side member is longer than said first side member.

3. Apparatus in accordance with claim 2 wherein said drive means is mounted on said frame proximate to said first side member.

4. Apparatus in accordance with claim 3 further comprising a rear support plate affixed to the rear edge of the base member and to the side members.

5. Apparatus in accordance with claim 4 further comprising a forward channel guide extending upwardly on the second side member and mounted thereon forward of said transport means.

6. Apparatus in accordance with claim 5 wherein the forward edge of said base member is longer than the rear edge thereon.

7. Apparatus in accordance with claim 6 wherein the forward edge of said base member is downwardly inclined.

8. Apparatus in accordance with claim 7 further comprising wedge-shaped support members affixed to said frame and extending beneath said base member.

9. Apparatus in accordance with claim 8 further comprising wedge-shaped support members affixed to said side members and extending forwardly to provide outwardly angled side members.

10. Apparatus in accordance with claim 9 further comprising a removable leading edge member affixed to the forward edge of said base member.

11. Apparatus in accordance with claim 9 further comprising a removable leading edge member affixed to the forward edge of said side members.

12. Apparatus in accordance with claim 3 further comprising a forward channel guide extending upwardly on the second side member and mounted thereon forward of said transport means.

13. Apparatus in accordance with claim 12 further comprising a rear channel guide extending upwardly on the second side member and mounted thereon rearward of said transport means.

14. Apparatus in accordance with claim 1 wherein said flights are affixed to the chain and extended outwardly therefrom, said flights being spaced adjacent to the second side member to urge debris therealong.

15. Apparatus in accordance with claim 14 wherein said flights each comprise a forward lip and rearward extension, the rearward extension being dimensioned to contact the lip of the next flight affixed to the chain.

* * * * *